US010046392B2

(12) United States Patent
El-Soudani et al.

(10) Patent No.: US 10,046,392 B2
(45) Date of Patent: Aug. 14, 2018

(54) CRACK-FREE FABRICATION OF NEAR NET SHAPE POWDER-BASED METALLIC PARTS

(71) Applicants: The Boeing Company, Chicago, IL (US); Fuji Jukogyo Kabushiki Kaisha

(72) Inventors: Sami M. El-Soudani, Cherritos, CA (US); Daniel Gordon Sanders, Lake Tapps, WA (US); Shinichi Yajima, Utsunomiya (JP)

(73) Assignee: The Boeing Company, Chicago, IL (US)

( * ) Notice: Subject to any disclaimer, the term of this patent is extended or adjusted under 35 U.S.C. 154(b) by 480 days.

(21) Appl. No.: 14/637,641

(22) Filed: Mar. 4, 2015

(65) Prior Publication Data

US 2016/0256927 A1 Sep. 8, 2016

(51) Int. Cl.

| | |
|---|---|
| ***B22F 3/04*** | (2006.01) |
| ***B22F 3/02*** | (2006.01) |
| ***B22F 3/12*** | (2006.01) |
| ***B30B 11/00*** | (2006.01) |
| ***B22F 1/00*** | (2006.01) |
| ***B22F 3/00*** | (2006.01) |
| ***B22F 3/16*** | (2006.01) |
| ***C22C 14/00*** | (2006.01) |

(52) U.S. Cl.

CPC ..... *B22F 3/04* (2013.01); *B22F 1/0003* (2013.01); *B22F 3/003* (2013.01); *B22F 3/02* (2013.01); *B22F 3/1216* (2013.01); *B22F 3/16* (2013.01); *B30B 11/00* (2013.01); *C22C 14/00* (2013.01); *B22F 2301/205* (2013.01); *B22F 2998/10* (2013.01)

(58) Field of Classification Search

CPC ..... B22F 3/04; B22F 3/045

See application file for complete search history.

(56) References Cited

U.S. PATENT DOCUMENTS

| | | | | |
|---|---|---|---|---|
| 3,324,544 | A | 6/1967 | Haller | |
| 3,785,038 | A | 1/1974 | Zapf | |
| 4,059,879 | A | 11/1977 | Chmura et al. | |
| 4,380,421 | A | 4/1983 | Morris | |
| 4,673,549 | A | 6/1987 | Ecer | |
| 4,861,546 | A | 8/1989 | Friedman | |
| 5,937,265 | A * | 8/1999 | Pratt | B22F 3/1258 419/42 |
| 5,963,775 | A | 10/1999 | Fang | |
| 7,168,858 | B2 | 1/2007 | Cadle et al. | |
| 8,419,400 | B2 | 4/2013 | Itoh et al. | |
| 2011/0014082 | A1 * | 1/2011 | Voice | B22F 3/1208 419/68 |

FOREIGN PATENT DOCUMENTS

| | | | |
|---|---|---|---|
| CN | 101905324 | A | 7/2010 |
| EP | 2275393 | A1 | 1/2011 |
| WO | WO9740777 | A2 | 11/1997 |

OTHER PUBLICATIONS

Extended European Search Report, dated Jul. 29, 2016, regarding Application No. 16158703.5, 7 pages.

* cited by examiner

*Primary Examiner* — Matthew E Hoban

(74) *Attorney, Agent, or Firm* — Yee & Associates, P.C.

(57) ABSTRACT

Crack-free powder-based, near net shaped parts are fabricated using a die assembly and cold isostatic pressing. Soft materials are introduced on both sides of die components in order to balance compression loads applied to the die component, and thereby avoid deformation of the die component.

20 Claims, 7 Drawing Sheets

CRACK-FREE FABRICATION OF NEAR NET SHAPE POWDER-BASED METALLIC PARTS

BACKGROUND INFORMATION

1. Field

The present disclosure generally relates to the powder metallurgy, and deals more particularly with a method and die for fabricating crack-free direct consolidated powder-based metallic parts.

2. Background

Powder metal technology is sometimes used to produce near-net-shape (NNS) metallic parts, eliminating the need for metal removal processes such as machining, and thereby reducing costs. Blended, fine powder materials such as titanium alloys are compacted into the shape of a part, known as a compact. The compact is then sintered in a controlled atmosphere to bond the powder materials into a finished part. In one compaction process known as cold isostatic compaction (CIP), a flexible die is filled with metallic powder and placed in a press where it is immersed within a working medium, such as a liquid. The press compresses the liquid, causing a compaction pressure to be uniformly applied around the surface of the die. The die flexes slightly, transmitting the compaction pressure to the powder to compress and form the compact. The compact is then removed from the die and transferred to a sintering furnace where elevated temperature bonds the metallic powder particles into a solid part.

Problems may be encountered where the die includes internal die components for forming features or details of the part. For example, where the internal die components are asymmetrically shaped or arranged, the applied compaction pressure may impose unbalanced loads on the die components which cause them to bend or deform. When a compaction cycle is complete and the compaction pressure is withdrawn, the deformed die components flex back to their original shape. This flex-back of the die components may generate localized biaxial tensile forces within the powder compact, particularly near the surface. At this stage of processing, the compact is relatively fragile and has minimal fracture toughness because the powder particles in the compact are not yet metallurgically bonded together. Consequently, in some cases, the tensile forces generated by flex-back of the internal die components may cause undesired deformation of the compact, and/or localized cracking of the compact.

Accordingly, there is a need for a method and a die for making crack-free NNS powder metal parts, particularly where the die includes die components subject to unbalanced loading.

SUMMARY

The disclosed embodiments enable crack-free fabrication of NNS parts from metallic powders that are direct consolidated using cold isostatic pressing and subsequent vacuum sintering into a solid part. Flex-back of internal die components causing residual tensile stresses in powder compacts is substantially eliminated. Reduction or elimination of biaxial tensile stresses reduces or eliminates the possibility of cracking of the powder compact. Lower tensile stresses are achieved by introducing metallic powder on both sides of internal die components used to shape metallic powder and react compaction forces.

According to one disclosed embodiment, a method is provided of fabricating a near net shape metallic part. The method comprises placing at least one die component inside a flexible container, the die component having opposite sides and a plane extending therethrough. The method further comprises filling the container with a metallic powder, including placing the metallic powder on both of the opposite sides, and compacting the metallic powder into a powder compact, including compressing the flexible container. The method also includes removing the powder compact from the container, and sintering the powder compact into a solid part. The die component may be a metal plate, and filling the container may include introducing a layer of the metallic powder into a lower interior region of the container, and placing at least one die component includes placing the metal plate on the layer of the metallic powder. Filling the container includes introducing a layer of the metallic powder into an upper interior region of the container covering the metal plate. The metallic powder may be a hydride-dehydride blended-elemental powder titanium alloy composition. Compacting the metallic powder into a powder compact is performed using cold isostatic pressing.

According to another disclosed embodiment, a method is provided of producing a crack-free metallic powder compact, comprising filling a flexible container with metallic powder, and placing at least one die component in the flexible container, including arranging the die component within the metallic powder in a manner that substantially prevents bending of the die component under load. The method further comprises compacting the metallic powder into a desired powder compact by subjecting the flexible container to a hydrostatic pressure. Arranging the die component within the metallic powder includes introducing the metallic powder on opposite sides of the die component. Arranging the die component with the metallic powder may include placing the die component between two layers of the metallic powder. Compacting the metallic powder into the desired powder compact may be performed by cold isostatic pressing. Arranging the die component may include positioning the die component symmetrically within the container.

According to another disclosed embodiment, a method is provided of producing a crack-free metallic powder compact, comprising fabricating at least one relatively stiff die component, and placing the die component in a flexible container. The method also includes introducing a layer of metallic powder into the flexible container covering the die component, and introducing a layer of relatively soft material beneath the flexible container to balance loading of the die component during compaction. The method further comprises compacting metallic powder into a powder compact by subjecting the flexible container to a hydrostatic pressure. Introducing the layer of relatively soft material may be performed by introducing metallic powder into the flexible container. Fabricating the die component may include producing a set of symmetric mirror image die features, and compacting the metallic powder may be performed by cold isostatic pressing.

According to still another disclosed embodiment, a die assembly is provided for fabricating metallic powder-based parts. The die assembly includes a container having flexible walls configured to be compressed by hydrostatic pressure, and at least one relatively stiff die component located within the container for forming features of the parts, the die component having first and second opposite sides and a plane of overall symmetry. The die assembly further comprises a layer of metallic powder on the first side of the die component, and a layer of relatively soft material on the second side of the die component for balancing loads applied to the die component resulting from compression of the container by the hydrostatic pressure. The relatively soft material may be a metallic powder, and each of the metallic powder and the relatively soft material may be a titanium powder and an alloying element powder. The die component includes a first set of elements on the first side of the die component for forming features of a first part, and a second set of elements on the second side of the die component for forming features of a second part. The first set of elements is a mirror image of the second set of elements. The first and second sets of elements are symmetric about the plane of overall symmetry.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and advantages thereof, will best be understood by reference to the following detailed description of an illustrative embodiment of the present disclosure when read in conjunction with the accompanying drawings, wherein:

DETAILED DESCRIPTION

The disclosed embodiments provide a method and die assembly for fabricating crack-free, direct consolidated, near net shape (NNS) powder-based metallic parts. For example, referring to FIG. 1, the disclosed embodiments may be employed to fabricate a generally rectangular metallic part 20 which may have one or more details or features such as recesses 22. The part 20 is fabricated by compacting a desired metallic powder into a green powder compact substantially matching the shape of the part 20, and then sintering the powder compact into a solid part. The disclosed embodiments may be employed to fabricate parts from a wide range of metallic powders and alloys, including, without limitation titanium alloy powders such as hydride-dehydride blended-elemental powder for the titanium alloy SP 700, or Ti-6Al-4V.

Figure 1:
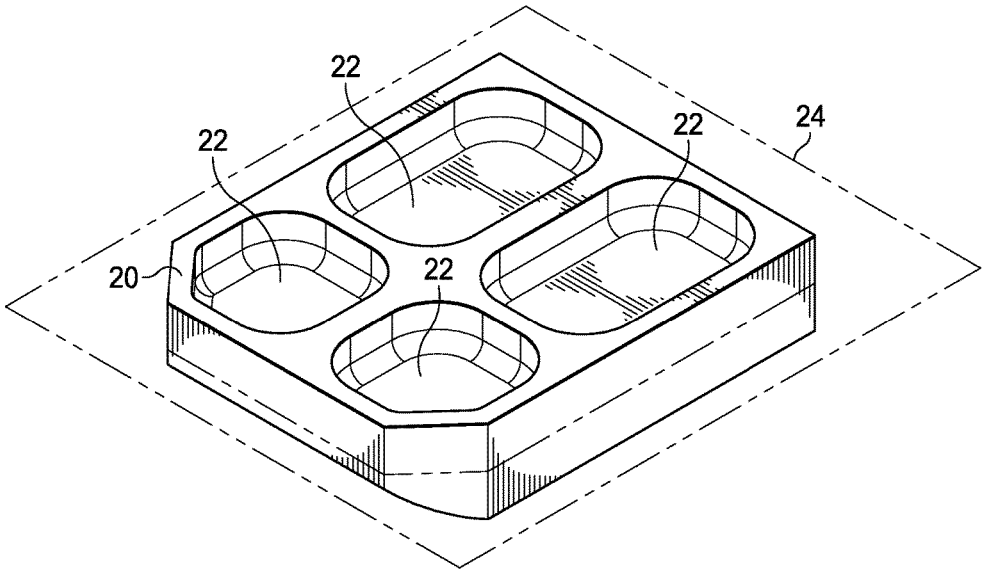
FIG. 1 is an illustration of a perspective view of a metallic part, also showing the plane of overall symmetry of the part.
Figure 2:
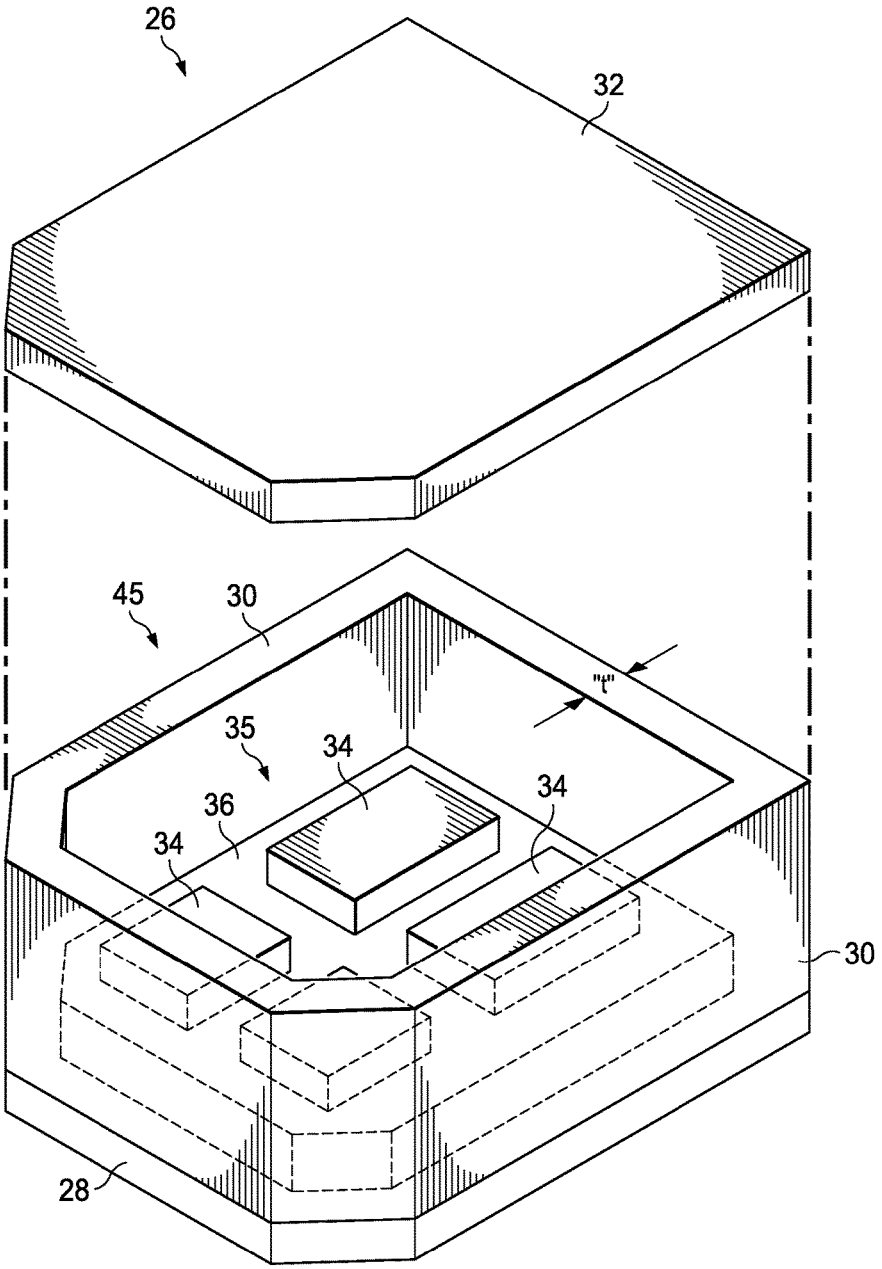
FIG. 2 is an illustration of an exploded perspective view of a die assembly used to mold the metallic part shown in FIG. 1.
Figure 3:
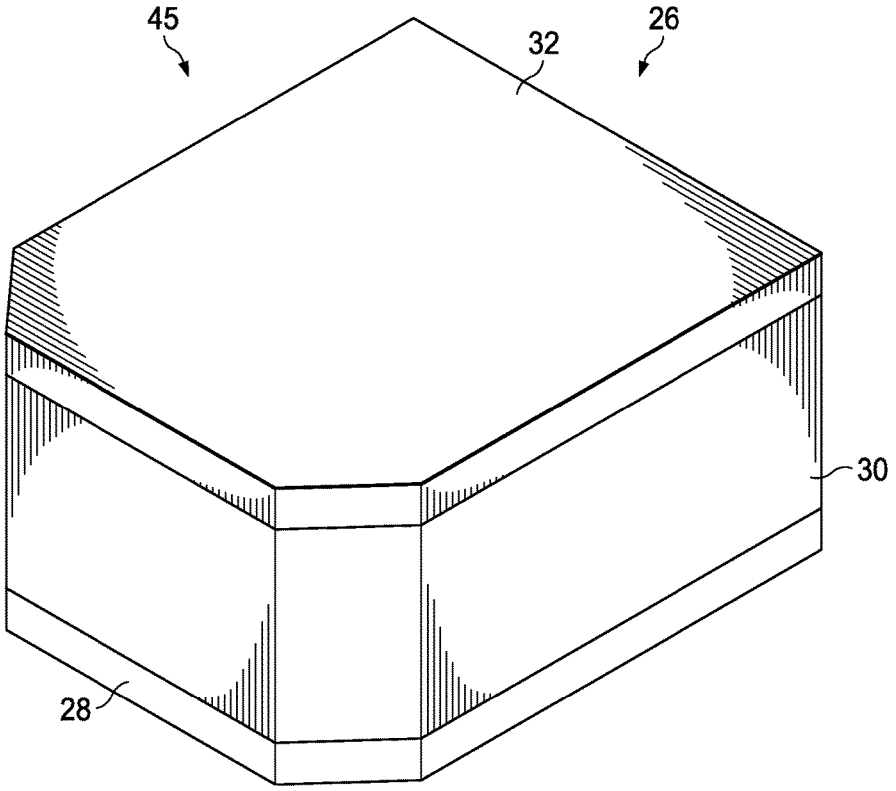
FIG. 3 is an illustration similar to FIG. 2 but showing the die assembly fully assembled.

Referring now to FIGS. 2 and 3, the part 20 shown in FIG. 1 may be fabricated using a direct consolidation technique in which metallic powder is formed into a powder compact by cold isostatic pressing (CIP) or a similar process. The powder compact is produced using a die assembly 26 broadly comprising one or more die components 35 arranged inside a box-like flexible container 45. The die components 35 have a center of stiffness about a plane 24, which for convenience of this description, will be referred to hereinafter as a plane of overall symmetry 24. The die components 35 include a substantially flat plate 36 formed of a relatively stiff materials such as steel, and a plurality of metal elements or inserts 34 configured to form features of the part 20, such as the recesses 22 of the part 20. The flexible container 45 may be formed from a rubber or a plastic, and includes a bottom wall 28, sidewalls 30 with a desired thickness "t" and a removable top wall 32. The container 45 may be formed of any suitable material that is flexible, but possesses sufficient stiffness to maintain the desired shape of the powder compact.

Figure 4:
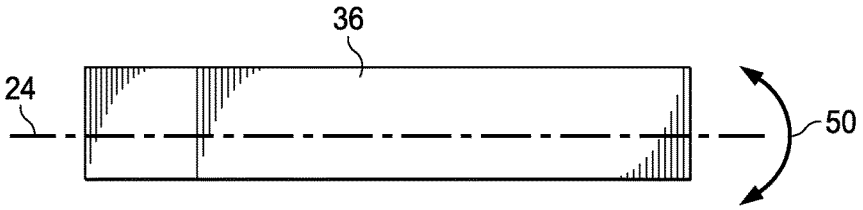
FIG. 4 is an illustration of a side elevational view of a steel plate forming one of the components of the die assembly shown in FIGS. 2 and 3.

In use, the die components 35 are set and arranged within the container 45, and the container 45 is filled with a desired metallic powder. The metallic powder is then tapped down and the container top wall 32 is installed. The die assembly 26 is placed in an isostatic press (not shown) in which the container hydrostatic compaction pressure is applied to all surfaces of the container 45. As mentioned above, the pressure applied to the container 45 is transmitted to the metallic powder, pressing it into a powder compact that may then be sintered into a solid part 20. Depending on the geometry of the part 20 and the location/orientation of the plane of overall symmetry 24, the pressure applied to the container 45 during the compaction process may result in unbalanced loads being applied to the plate 36 which may deform the plate 36. For example, referring to FIG. 4, unbalanced loads may result in a bending moment 50 being applied to the plate 36, causing the plate 36 to deform during the compaction process, but then flex-back to its original shape when the compaction load is withdrawn.

Figure 5:
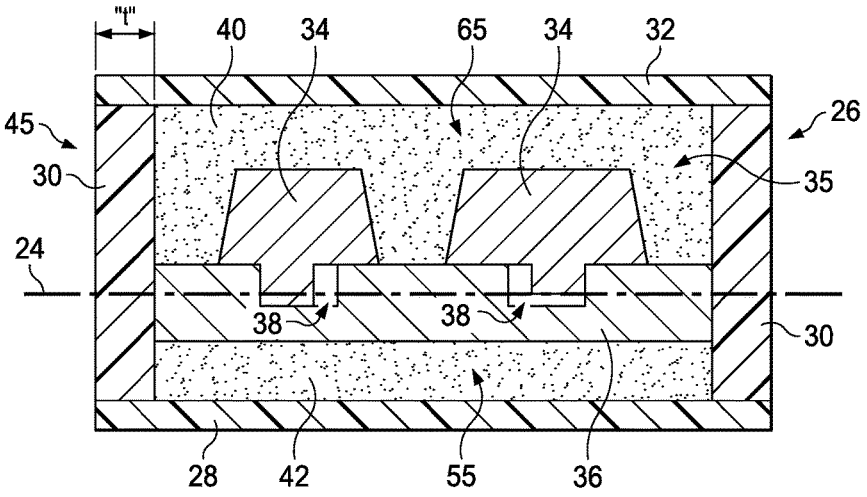
FIG. 5 is an illustration of a cross-sectional view of one embodiment of a die assembly for fabricating crack-free powder based parts.
Figure 6:
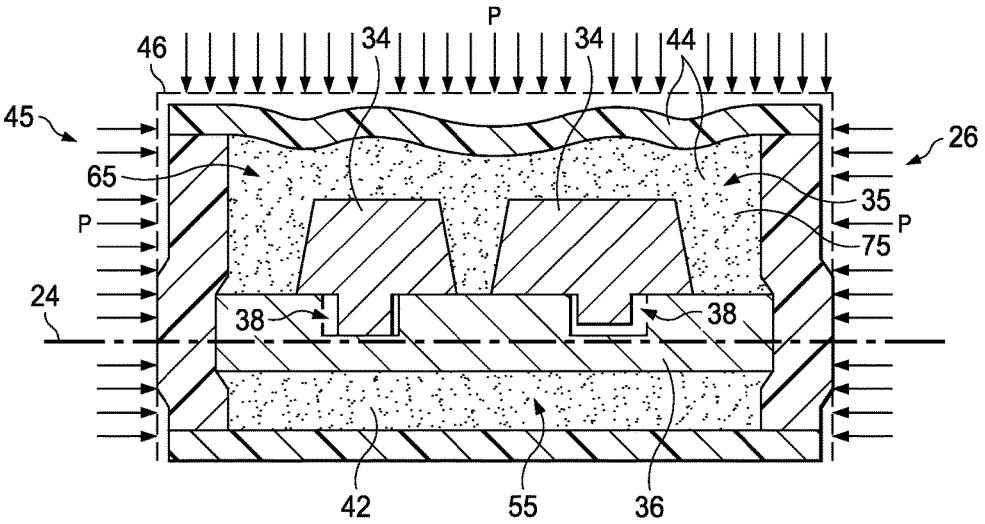
FIG. 6 is an illustration similar to FIG. 5 but showing deformation of the flexible container subjected to isostatic pressure.

FIGS. 5 and 6 illustrate one embodiment of die assembly that substantially reduces or eliminates deformation of the plate 36 by balancing the loads applied to the plate 36 during the compaction process. In this example the inserts 34 are movable within slots 38 formed in the plate 36. A suitably soft material 42, such as a powder, is introduced into a lower interior region of the container 45, between the plate 36 and the bottom wall 28 of the container 45, forming a layer of soft material on one side of the plate 36. The upper interior region 65 above the plate 36 is filled with the desired metallic powder that is to be pressed into a powder compact. The soft material 42 in the lower interior region 55 may comprise, for example and without limitation, the same metallic powder that fills interior region 65, or a different material providing that it is less stiff than the stiffness of the plate 36. Thus, it may be appreciated that relatively soft material (metallic powder) is introduced on both sides of the relatively stiff plate 36, in contrast to the previous practice of placing metallic powder only on one side of the plate 36.

Referring particularly to FIG. 6, when a hydrostatic compaction force "P" is applied to the container 45 during cold isostatic pressing, the walls 28, 30, 32 deform inwardly to the position indicated by the broken line 46, transmitting compaction force to the powder 42, 40 respectively in the interior regions 55, 65. The applied compaction force "P" compresses 44 the metallic powder 40 into a powder compact 75 (FIG. 6) having the desired part shape. Thus, the applied compaction forces "P" are transmitted through the two regions 55, 65 and are reacted by the plate 36 on both sides of the plane of overall symmetry 24. Consequently, the forces applied to the plate 36 are substantially balanced on each side of the plane of overall symmetry 24, thereby substantially preventing deformation of the plate 36. Because the plate 36 does not substantially deform under the applied compaction pressure, flex-back of the plate 36 does not occur and tensile stresses within the power compact are avoided. In effect, the layer of soft powder material in the lower interior region 55 beneath the plate 36 prevents bending of the plate 36 under load.

Figure 7:
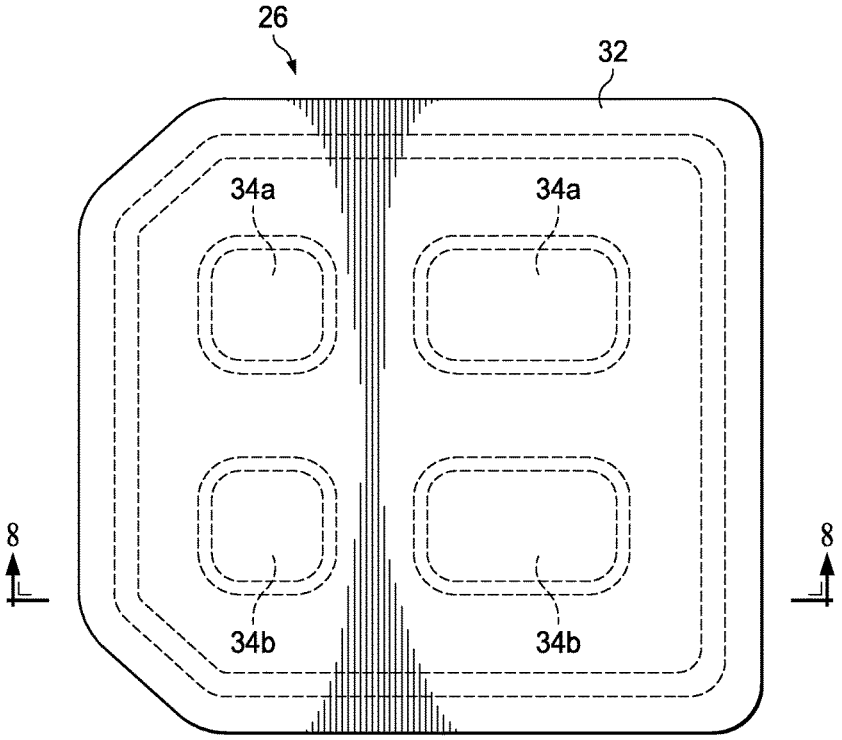
FIG. 7 is an illustration of a plan view of another embodiment of a die assembly for fabricating crack free metallic parts.
Figure 8:
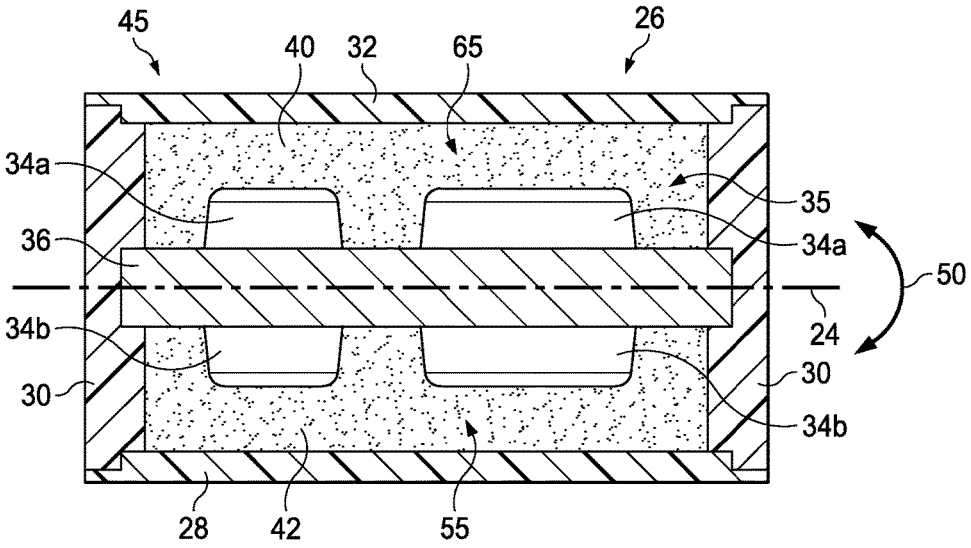
FIG. 8 is an illustration of a sectional view taken along the line 8-8 in FIG. 7.

Attention is now directed to FIGS. 7 and 8 which illustrate another embodiment of a die assembly 26 that is configured to avoid deformation of the plate 36 during the compaction process by introducing metallic powder on both sides of an internal die component that is subject to deformation and subsequent flex back. By avoiding deformation of the plate 36 during the compaction process, crack-inducing tensile stresses in the powder compact are avoided which may otherwise result from flex-back of the plate 36 in the event that it is deformed. In this embodiment, the lower the interior region 55 is enlarged and two sets of die components in the form of die inserts 34*a*, 34*b* are placed respectively on opposite sides of the plate 36. The layout of the die components 34*a*, 34*b*, 36 in the interior regions 55, 65 of the container 45 are essentially mirror images of each other. The interior regions 65, 55 are substantially of equal volume and each is filled with the desired metallic powder 40, 42, allowing a pair of powder compacts to be simultaneously fabricated in a single die assembly 26.

The embodiment of the die assembly 26 shown in FIGS. 7 and 8 may be regarded as symmetric in the sense that the two open interior regions 55, 65 that are filled with metallic powder are substantially identical and are symmetric relative to the plane of overall symmetry 24. In contrast, the embodiment of the die assembly 26 shown in FIGS. 5 and 6 may be considered to be a quasi-symmetric configuration in which metallic powder filled interior regions 55, 65, though not identical, are likewise disposed on opposite sides of the plane of overall symmetry 24 of the plate 36. In other words, like the embodiment shown in FIGS. 5 and 6, metallic powder is introduced on both sides of the plate 36. Because the metallic powder filled interior regions 55, 65 are essentially mirror images of each other, loading of the die components (especially the plate 36) is balanced during compaction process and the application of bending moments 50 causing the plate 36 to deform are avoided. Consequently, there is no flex-back of the plate 36 that may induce tensile forces in the compact which could result in cracking. In some applications, undesired residual tensile forces in the compact 75 may also be reduced by increasing the stiffness of the container sidewalls 30, as by increasing their thickness "t".

Figure 9:
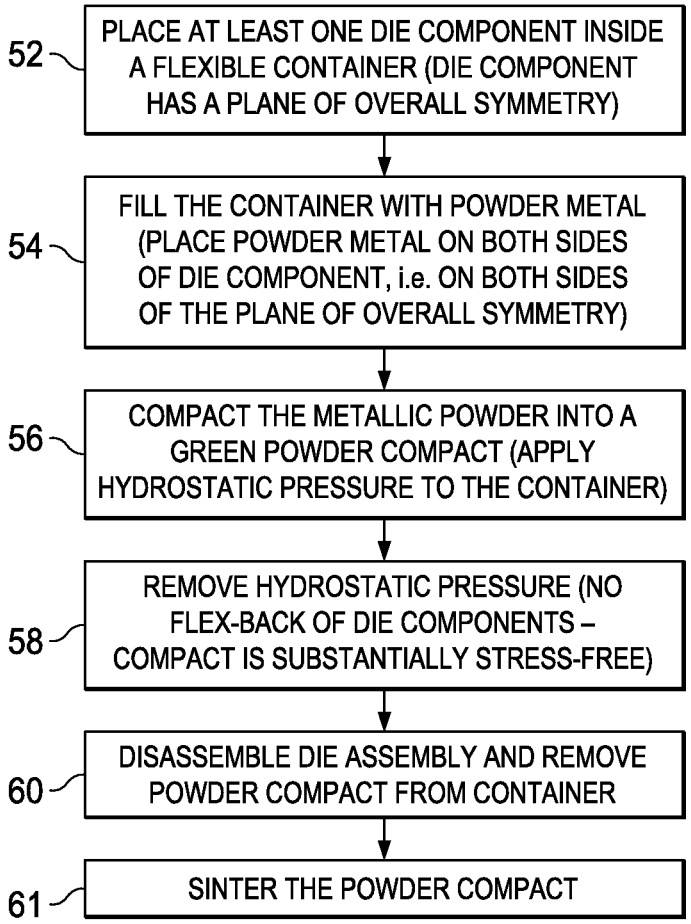
FIG. 9 is an illustration of a flow diagram of a method of fabricating direct consolidated metallic powder parts.

FIG. 9 broadly illustrates the overall steps of a method of fabricating a crack-free metallic powder part 20 using embodiments of the die assembly 26 described above. Beginning at 52, at least one die component 36 is placed inside a flexible container 45. The die component (i.e. plate 36) has a plane of overall symmetry 24. At 54, the flexible container 45 is filled with a desired metallic powder 40, 42, and the desired metallic powder is placed on both sides of the die component, and thus on both sides of the die component's plane of overall symmetry 24. At 56, the metallic powder 40, 42 is compacted into a green powder compact 75 by compressing the container 45 using, for example and without limitation, hydrostatic pressure generated by an isostatic press (not shown). At 58, the hydrostatic pressure is removed from the container and the powder compact remains stress-free because the die components do not deform and then flex-back. At 60, the die assembly is disassembled and the powder compact 75 is removed from the container 45. Finally, at 61 the power compact 75 is sintered into a solid part 20.

Figure 10:
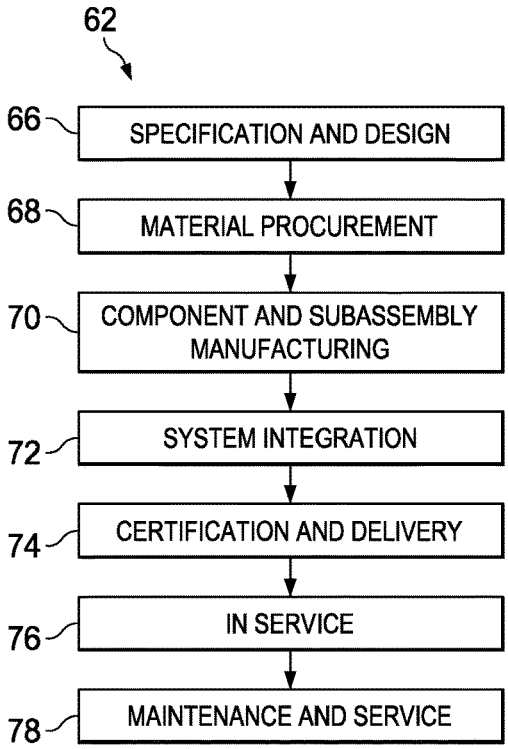
FIG. 10 is an illustration of a flow diagram of aircraft production and service methodology.
Figure 11:
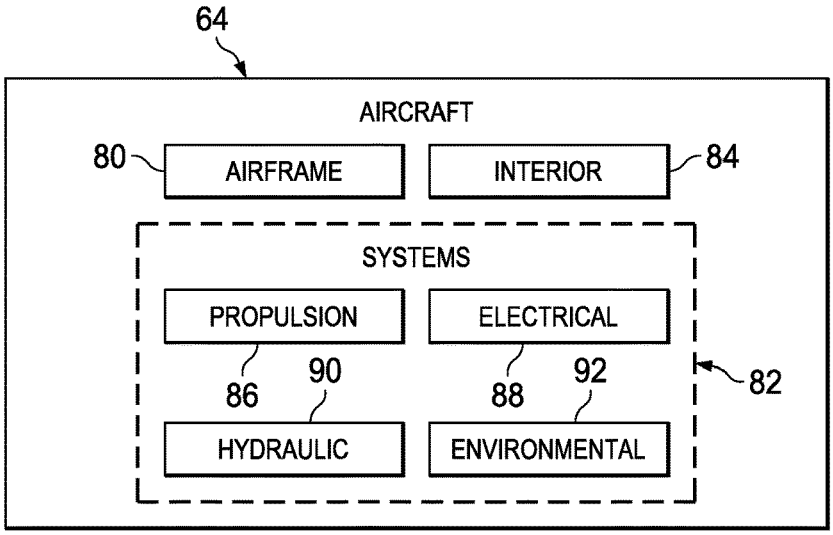
FIG. 11 is an illustration of a block diagram of an aircraft.

Embodiments of the disclosure may find use in a variety of potential applications, particularly in the transportation industry, including for example, aerospace, marine, automotive applications and other application where metallic parts may be used. Thus, referring now to FIGS. 10 and 11, embodiments of the disclosure may be used in the context of an aircraft manufacturing and service method 62 as shown in FIG. 10 and an aircraft 64 as shown in FIG. 11. Aircraft applications of the disclosed embodiments may include, for example, without limitation, light-weight metallic parts used in the airframe or other on board systems. During pre-production, exemplary method 62 may include specification and design 66 of the aircraft 64 and material procurement 68. During production, component and subassembly manufacturing 70 and system integration 72 of the aircraft 64 takes place. Thereafter, the aircraft 64 may go through certification and delivery 74 in order to be placed in service 76. While in service by a customer, the aircraft 64 is scheduled for routine maintenance and service 78, which may also include modification, reconfiguration, refurbishment, and so on.

Each of the processes of method 62 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 11, the aircraft 64 produced by exemplary method 62 may include an airframe 80 with a plurality of systems into and an interior 84. Examples of high-level systems 82 include one or more of a propulsion system 86, an electrical system 88, a hydraulic system 90 and an environmental system 92. Any number of other systems may be included. Although an aerospace example is shown, the principles of the disclosure may be applied to other industries, such as the marine and automotive industries.

Systems and methods embodied herein may be employed during any one or more of the stages of the production and service method 62. For example, components or subassemblies corresponding to production process 70 may be fabricated or manufactured in a manner similar to components or subassemblies produced while the aircraft is in service. Also, one or more apparatus embodiments, method embodiments, or a combination thereof may be utilized during the production stages 70 and 72, for example, by substantially expediting assembly of or reducing the cost of an aircraft 64. Similarly, one or more of apparatus embodiments, method embodiments, or a combination thereof may be utilized while the aircraft 64 is in service, for example and without limitation, to maintenance and service 78.

As used herein, the phrase "at least one of", when used with a list of items, means different combinations of one or more of the listed items may be used and only one of each item in the list may be needed. For example, "at least one of item A, item B, and item C" may include, without limitation, item A, item A and item B, or item B. This example also may include item A, item B, and item C or item B and item C. The item may be a particular object, thing, or a category. In other words, at least one of means any combination items and number of items may be used from the list but not all of the items in the list are required.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different advantages as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method of fabricating a near net shape metallic part, comprising:

placing at least one die component inside a flexible container, the at least one die component having opposite sides and a plane of overall symmetry, wherein the at least one die component has a center of stiffness about the plane of overall symmetry;

filling the flexible container with a metallic powder, including placing the metallic powder on both sides of the plane of overall symmetry and contacting the opposite sides of the at least one die component;

compacting the metallic powder on a first side of the at least one die component into a powder compact, including compressing the flexible container, such that forces applied to the at least one die component are substantially balanced on each side of the plane of overall geometry;

removing the powder compact from the container; and sintering the powder compact into a solid part.

2. The method of claim 1, wherein the metallic powder is a hydride-dehydride blended-elemental powder titanium alloy composition.

3. The method of claim 1, wherein compacting the metallic powder into a powder compact is performed using cold isostatic pressing.

4. A method of producing a crack-free metallic powder compact, comprising:

adding a metallic powder to a lower interior region of a flexible container;

placing at least one die component onto the metallic powder in the lower interior region of the flexible container to form a first metallic powder filled interior region;

adding the metallic powder to the flexible container on top of the at least one die component;

installing a container wall to form a second metallic powder filled interior region; and compacting the metallic powder into a desired powder compact by subjecting the flexible container to a hydrostatic pressure.

5. The method of claim 4, wherein compacting the metallic powder into the desired powder compact is performed by cold isostatic pressing.

6. A method of producing a crack-free metallic powder compact, comprising:

fabricating at least one stiff die component;

placing the at least one die component in a flexible container;

introducing a layer of metallic powder into the flexible container covering the at least one die component;

introducing a layer of soft powder material into the flexible container to balance loading of the at least one die component during compaction; and compacting the metallic powder into a powder compact by subjecting the flexible container to a hydrostatic pressure, wherein compacting the metallic powder into a powder compact comprises compacting the metallic powder within a first interior region formed by the at least one die component and the flexible container, wherein a first side of the first interior region is formed by the at least one die component and a remainder of the first interior is fottned by the flexible container.

7. The method of claim 6, wherein fabricating the die component includes producing a set of symmetric mirror image die features.

8. The method of claim 6, wherein compacting the metallic powder is performed by cold isostatic pressing.

9. The method of claim 1, wherein the flexible container is formed of one of a rubber or a plastic.

10. The method of claim 1, wherein filling the flexible container with a metallic powder comprises creating two metallic powder filled interior regions that are mirror images of each other.

11. The method of claim 1, wherein the at least one die component comprises a metal plate and a plurality of metal inserts movable within slots formed in the metal plate.

12. The method of claim 1, wherein the plane of overall symmetry is between two interior regions within the flexible container.

13. The method of claim 4, wherein the metallic powder is a hydride-dehydride blended-elemental powder titanium alloy composition.

14. The method of claim 4, wherein the flexible container is formed of one of a rubber or a plastic.

15. The method of claim 4, wherein the first metallic powder filled interior region and second metallic powder filled interior region are mirror images of each other.

16. The method of claim 4, wherein the at least one die component comprises a metal plate and a plurality of metal inserts movable within slots formed in the metal plate.

17. The method of claim 4, wherein compacting the metallic powder into a desired powder compact forms two crack-free metallic powder compacts having a same design.

18. The method of claim 6, wherein the metallic powder is a hydride-dehydride blended-elemental powder titanium alloy composition.

19. The method of claim 6, wherein the flexible container is formed of one of a rubber or a plastic.

20. The method of claim 6, wherein the at least one die component comprises a metal plate and a plurality of metal inserts movable within slots formed in the metal plate.

* * * * *